US005272972A

United States Patent [19]

Tobita

[11] Patent Number: 5,272,972

[45] Date of Patent: Dec. 28, 1993

[54] ARRANGEMENT FOR INKING AND DOCTORING IN A PAD PRINTING MACHINE

[75] Inventor: Joji Tobita, Saitama, Japan

[73] Assignee: Daiichi Machinery Service Co., Ltd., Tokyo, Japan

[21] Appl. No.: 986,159

[22] Filed: Dec. 3, 1992

Related U.S. Application Data

[63] Continuation-in-part of Ser. No. 859,632, Mar. 20, 1992, abandoned, which is a continuation of Ser. No. 627,720, Dec. 14, 1990, abandoned, which is a continuation-in-part of Ser. No. 253,416, Oct. 4, 1988, abandoned, which is a continuation of Ser. No. 131,280, Dec. 10, 1987, abandoned, which is a continuation of Ser. No. 783,845, Oct. 3, 1985, abandoned.

[30] Foreign Application Priority Data

Oct. 4, 1984 [JP] Japan ..... 59-208727

[51] Int. Cl.[5] ..... B41F 1/42; B41F 1/00

[52] U.S. Cl. ..... 101/163; 101/169

[58] Field of Search ..... 101/163, 164, 165, 166, 101/41, 42, 43, 44, 150, 151, 157, 158, 159, 163–166

[56] References Cited

U.S. PATENT DOCUMENTS 4,557,195 12/1985 Phlipp ..... 101/163

FOREIGN PATENT DOCUMENTS 2205430 8/1972 Fed. Rep. of Germany ..... 101/41

*Primary Examiner*—J. Reed Fisher

*Attorney, Agent, or Firm*—Anderson Kill Olick & Oshinsky

[57] ABSTRACT

An inking and doctoring arrangement for a pad printing press includes a unidirectionally rotatable replaceable flat printing plate, a doctor blade arranged above the printing plate and displaceable relative thereto for scraping ink from the upper surface of the printing plate, and an ink tray for fixedly receiving the printing plate.

A tray cover is rotatably supported on the ink tray above the printing plate for preventing evaporation of the ink thinner. An ink guide is fixedly secured to the tray cover for joint rotation therewith for spreading ink scrapped by the doctor blade over the upper surface of the printing plate while kneading the same.

8 Claims, 13 Drawing Sheets

ARRANGEMENT FOR INKING AND DOCTORING IN A PAD PRINTING MACHINE

RELATED APPLICATIONS

This is a continuation-in-part application of Ser. No. 07/859,632, filed Mar. 20, 1992now abandoned, which in turn is a continuation application of Ser. No. 07/627,720, filed Dec. 14, 1990, (now abandoned) which in turn is a continuation-in-part application of Ser. No. 07/253,416, filed Oct. 4, 1988, (now abandoned) which in turn is a continuation application of Ser. No. 07/131,280, filed Dec. 10, 1987, (now abandoned) which in turn is a continuation application of Ser. No. 06/783,845, filed Oct. 3, 1985 (now abandoned).

BACKGROUND OF THE INVENTION

1. Field of the Invention

This invention relates to a process of and an arrangement for inking and doctoring a printing plate for use in a pad printing machine. In particular, the invention concerns a process and an arrangement where ink is applied to a design provided on a printing plate, the plate is doctored by a suitable doctor blade and then ink is picked up from recessed parts of the printing plate by means of a pad provided as a part of the printing machine.

2. Discussion of the Prior Art

In known pad printing machines, a printing plate having a design or pattern etched therein usually is mounted within an ink tray, a doctor blade being arranged to scrape excess ink off the surface of the plate and so to leave ink in the recessed parts of the plate.

The prior arrangements generally have been of one of two types. In one, the ink tray is fixed while the doctor blade and so on are arranged to be movable horizontally over the surface of the plate. In the other, the doctor blade and so on are fixed, and the ink tray is moved horizontally below the blade. These arrangements both require the ink tray to be open from the top, so that thinners or other components of the ink evaporate over a period of time. Consequently, if printing is to be continued for some time, the ink must appropriately be replenished, for example, by means of an automatic thinner adding device. Also foreign matter may easily fall into the ink tray and so contaminate the ink.

In an attempt to overcome the difficulties of an open ink try, there has been a proposal to contain the ink within a pot which bears on the printing plate and has an opening in that region to permit the application of ink to the plate. This arrangement however requires a very high degree of flatness for the printing plate and so is applicable mainly to printing plate having a relatively small printing area.

A further problem with the known arrangement is that the two steps, of doctoring the printing plate and of reapplying the ink, are both necessary in each cycle of the printing operation and so it has been difficult to accomplish continuous printing operation at a relatively high speed.

SUMMARY OF THE INVENTION

It is a principal object of the present invention to reduce the problems discussed above of the known inking and doctoring processes and arrangements in pad printing machines.

According to one aspect of this invention, there is provided an inking and doctoring process for a pad printing machine in which ink is applied to a design provided on a printing plate, the plate is doctored and then ink is picked up from recessed parts of the printing plate by means of a pad provided as a part of the printing machine, which process is characterized by the cyclic performance of a first step of relatively rotating the printing plate and a doctor blade to effect the doctoring of the plate, and a second step of picking up ink from the printing plate by the printing machine pad while the doctor blade is in a state of rest.

The relative rotation between the printing plate and the doctor blade either may be performed stepwise with the rotation each time being in the same direction, or may be performed in a back-and-forth manner. In both cases, the doctor blade may be maintained fixed whilst the printing plate is rotated or the printing plate may be maintained stationary whilst the doctor blade is moved rotatively in a back-and-forth manner.

An advantage of the process of this invention is that re-inking by using a separately movable ink applicator may not be necessary in each printing cycle. This allows the process to be performed at a relatively high speed. Moreover, the printing plate may have more than one printing area which areas are successively doctored, so permitting printing at a high rate.

According to another aspect of this invention, there is provided an inking and doctoring arrangement for a pad printing machine including an ink tray in which a printing plate and a doctor blade arranged to scrape ink off the upper surface of the printing plate are mounted, characterized in that there is provided a drive device adapted to cause relative rotational movement between the printing plate and the doctor blade to effect doctoring of the plate, and in that an ink tray cover is disposed over the ink try to minimize evaporation of ink components.

In this arrangement, the portion of the ink tray containing the ink is kept almost completely closed and it is enough that only a part of the ink tray is left open to allow a printing pad to descend to pick up ink in the design to be printed, so that components of the ink (such as thinners) can largely be prevented from evaporating. Moreover, the probability of foreign matter entering the ink is much reduced.

For a case where the relative rotation is performed stepwise and in the same direction, it is preferred for the doctor blade to be shaped so as to define a closed area (such as a circular area) within which area a design on the printing plate to be printed may lie, doctoring taking place as that design moves under the blade. Alternatively, for a case where the relative rotation is performed in a back-and-forth manner, two doctor blades may be provided, arranged alternately to contact the printing plate, depending upon the direction of relative movement between the doctor blades and the printing plate.

The various features of novelty which characterize the invention are pointed out with particularity in the claims annexed to and forming a part of this disclosure. For a better understanding of the invention, its operating advantages and specific objects attained by its use, reference should be had to the accompanying drawings and description in which there are illustrated and described the preferred embodiments of the invention.

BRIEF DESCRIPTION OF THE DRAWINGS

In the drawings:

FIGS. 6(*c*) and 6(*d*) illustrates a doctor blade clamping plate;

DETAILED DESCRIPTION OF THE PREFERRED EMBODIMENTS OF THE INVENTION

By way of example only, certain specific embodiments of the invention will now be described in detail with reference to the drawings.

Figure 1:
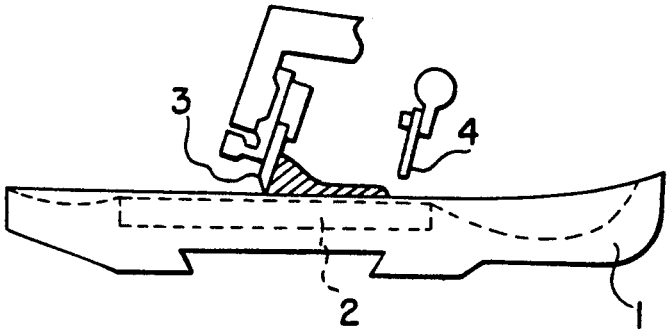
FIG. 1 PRIOR ART
FIG. 1 is a side view showing a conventional inking-/doctoring arrangement of a printing press.

Generally, as shown in FIG. 1 of the accompanying drawings, known inking part of the pad printing machine comprises an ink tray 1 with an open top in which is placed and fixed a printing plate 2, a doctor blade 3 being arranged to scrape ink off the surface of the plate and an ink return device 4 being arranged to reapply ink to the whole surface of the plate when the device is moved left to the drawings.

The inking part may be arranged in one of two ways. In one, the ink tray is fixed while the doctor blade and so on are arranged to be horizontally movable. In the other, the ink tray is arranged to be horizontally movable while the doctor blade and so on are stationary. In either case, the ink is scraped off the plate by means of the doctor blade 3 as the doctor blade 3 moves to the right (as viewed in FIG. 1) relative to the ink tray and then is returned or reapplied to the surf ace of the plate when the ink return device 4 moves to the left. As mentioned above, this inking part has the disadvantage that thinners for the ink evaporate in time, so necessitating the use of an automatic thinners adding device. In addition to that,, sine the two processes of doctoring and ink return are absolutely necessary, it has been difficult to accomplish continuous printing at a high speed.

Figure 2:
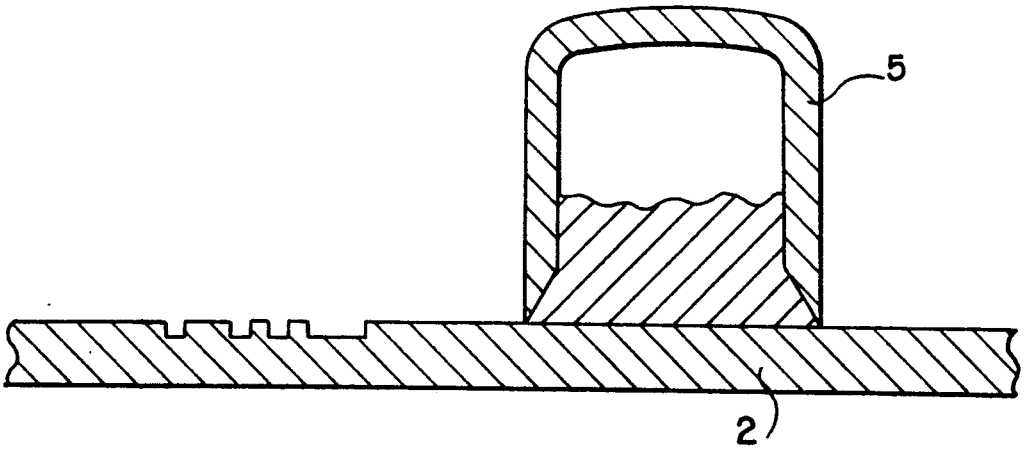
FIG. 2 PRIOR ART
FIG. 2 is a side view showing an ink pot and a printing plate arranged in accordance with the prior art.

FIG. 2 shows a known alternative doctoring arrangement, to prevent the evaporation of the thinners. Here, the ink is kept within a completely closed ink pot 5 disposed over the plate 2. This arrangement can however be used only with very flat printing plates and so is practical only with small print areas.

The lower ends of the ink pot 5 are made to contact the printing plate in a pressure contacting manner. The ink is placed in this ink pot and is supplied to recessed parts formed on the surface of the printing plate 2 when the plate is moved to the right in the drawing. The lower ends of the ink pot 5 are sharpened as knives and a doctoring is effected in a next step of the printing plate shifting to the left in the drawing. When the printing plate stops, the pad descends and picks up the ink from the printing plate.

Figure 3A:
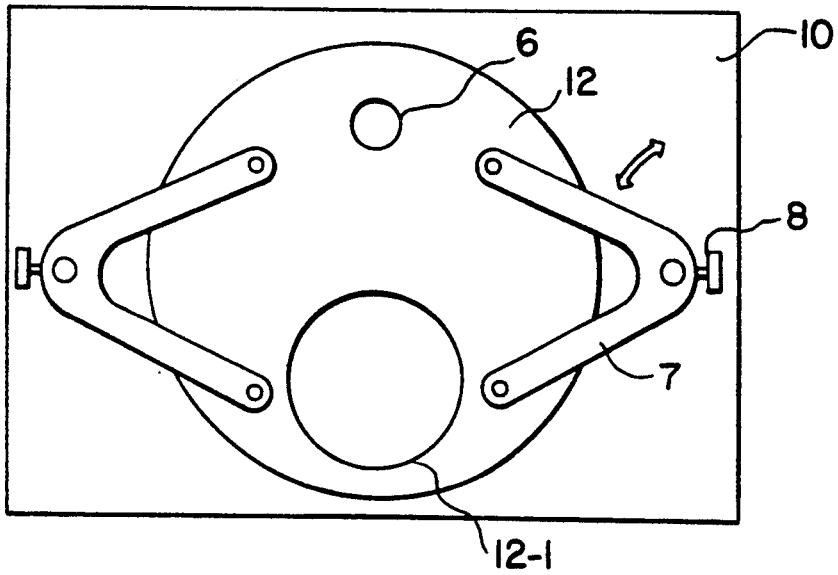
FIGS. 3(*a*) and 3(*b*) are schematic illustrations showing in outline an arrangement according to this invention for rotating an ink tray.
Figure 3B:
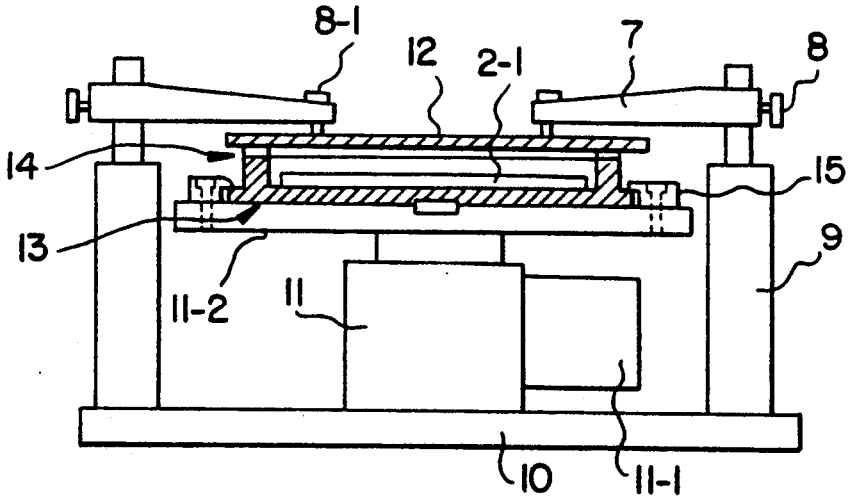

Referring now to FIGS. 3(*a*) and 3(*b*), showing schematically an arrangement of this invention, a base plate 10 is suitably mounted on the body of a pad printing machine (not shown). An ink tray cover 12 is provided with an ink supply port 6 and a pad passing port 12-1 which can have a pad pass therethrough and is secured to the upper part of an ink tray 13 by means of cover holders 7 which are pivotally attached to respective supports 9. Each of the cover holders 7 is fixed in a predetermined position by a screw 8 and is arranged to be movable vertically and turnable horizontally to facilitate removal and attachment of the ink tray cover 12. The ink tray 13 is mounted on an index drive 11 through an index table 11-1 and is arranged to be rotationally advanced stepwise. In the contact region between the ink tray 13 and the ink tray cover 11 is arranged a ring shaped low-friction evaporation preventing seal 14. The ink tray is fixed to the table support 11-2 with a clamp 15.

Figure 4A:
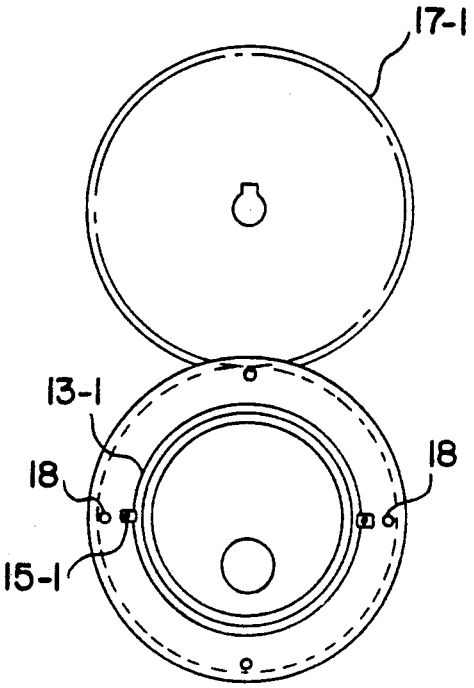
FIGS. 4(*a*), 4(*b*) and 4(*c*) are schematic illustrations of top, side and elevation views of embodiment of this invention for rotating an ink tray cover.
Figure 4C:
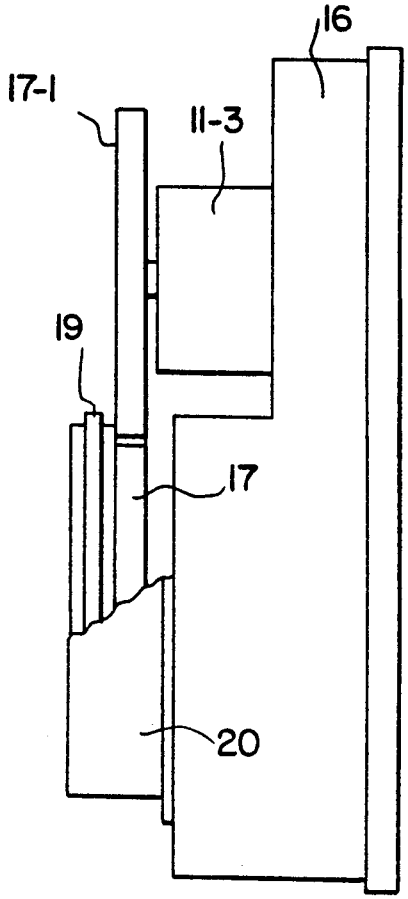
Figure 4B:
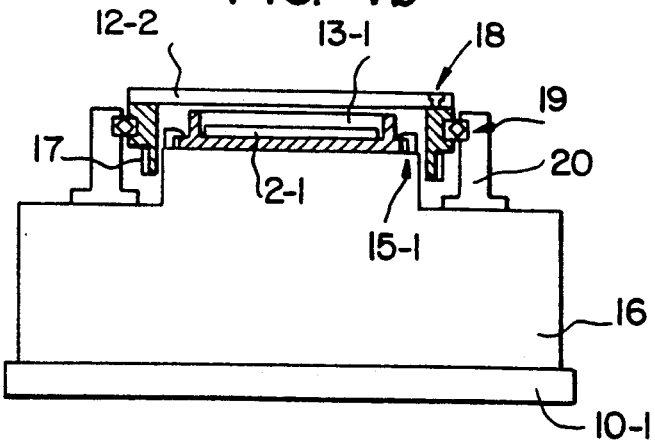

In FIG. 4 the ink tray 13-1 is fixed to the ink tray mount 16 by the ink tray fixing clamp 15-1. The ink tray cover 12-2 is fixed to the ink tray cover rotating gear 17 by bolts 18. The gear 17 is supported by the bearing supports 20 through the bearings 19 in a horizontally rotatable manner, and the driving side gear 17-1, which transmits the force to the gear 17, is mounted on the index drive 11-3.

Figure 5A:
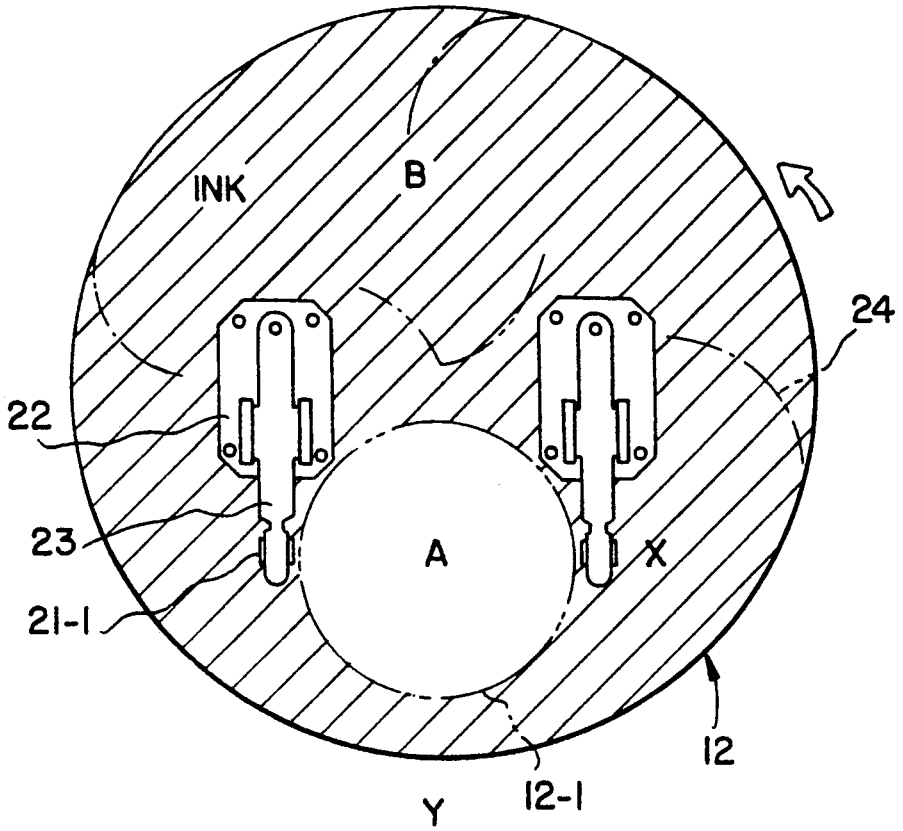
FIGS. 5(*a*) and 5(*b*) are illustrations of a cylindrical doctor blade holder and supports therefore.
Figure 5B:
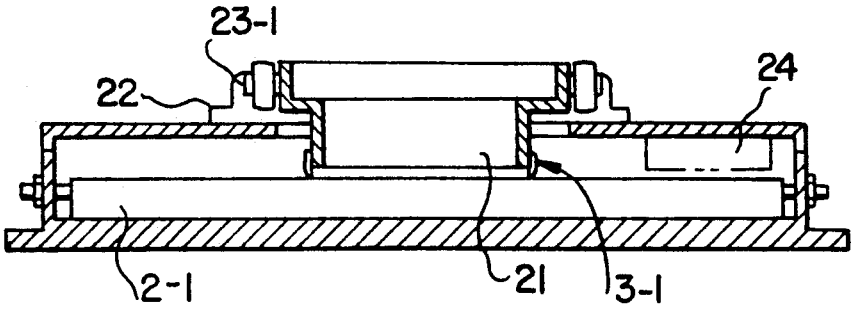
Figure 6A:
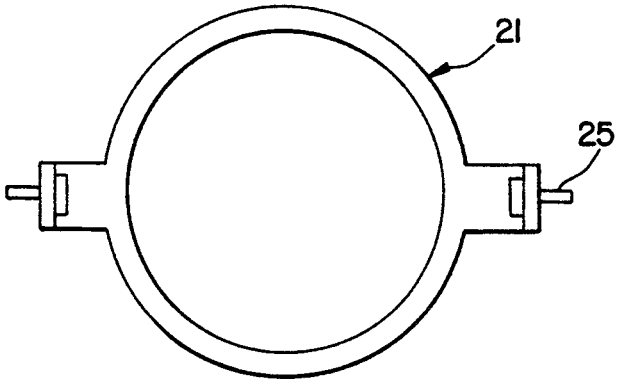
FIGS. 6(*a*) and 6(*b*) illustrate a cylindrical doctor blade holder.
Figure 6B:
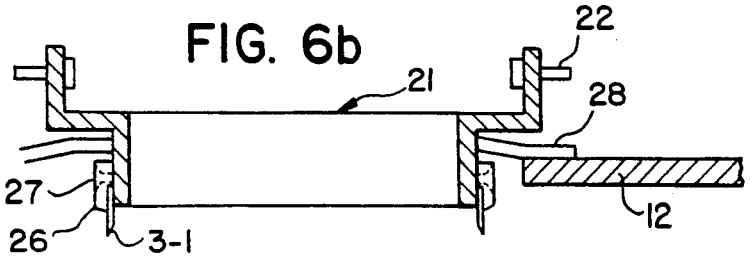
Figure 6C:
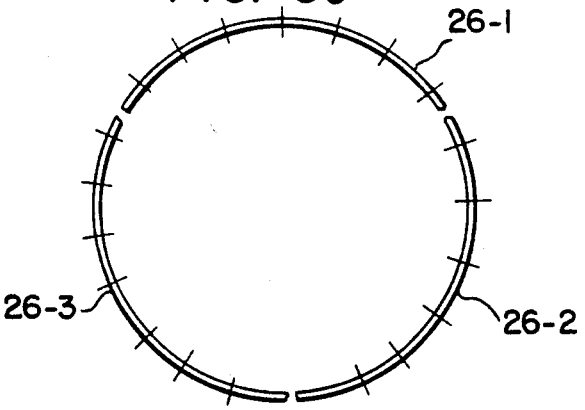
Figure 6D:
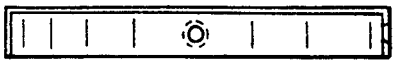

As shown in FIGS. 5 (*a*) and (*b*), the lengthy doctor blade 3-1 is wound around the cylindrical doctor blade holder 21. The holder 21 is retained in the bearing levers 23 through the spherical roller bearings 23-1, and the levers 23 are supported in a swingable manner by the supports 22 for bearing levers which are provided on the ink try cover 12. Therefore, if the rear portions of the levers 23 are pushed up by a spring, etc., the blade of the doctor blade 3-1 is pushed down onto the surface of the printing plate 2-1, thus the doctoring can be effected when the printing plate 2-1 rotates. The ink guide 24 is placed at such position that the ink which has been pushed over by the doctoring to the central portion and circumferential portion of the ink tray can be brought back and spread over the whole surface of the printing plate, and is fixed to the ink tray cover 12.

Referring to FIGS. 6(*a*)–6(*c*), the cylindrical doctor blade holder 21 is retained by the bearing levers 23 by inserting the holder supporting pins 25 into the spherical roller bearings 23-1 shown in FIG. 5. The doctor blade 3-1 is wound around the holder 21, and is pushed down by tightening the screws 27 in a condition where it is placed between the doctor blade clamping plate 26-1, 26-2, 26-3, which is divided into three pieces, and the holder 21. The flexible cover 28 is mounted by insertion into the holder 21, and when the holder 21 is set at the prescribed position, it also comes into contact with the ink tray cover 12, thus enhancing the tightness of closure within the ink tray.

Figure 7A:
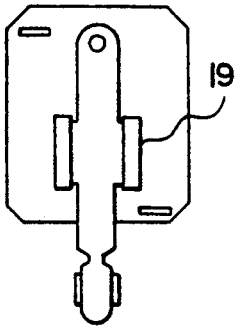
FIGS. 7(*a*) and 7(*b*) illustrates supports for the cylindrical doctor blade holder.
Figure 7B:
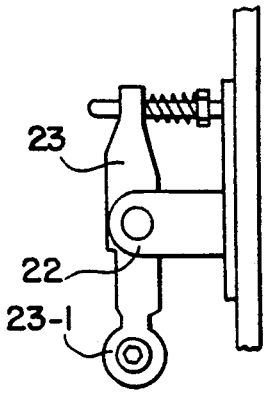

FIGS. 7 (*a*) and (*b*) show means for retention of the doctor blade holder 21 in place, and a compression spring provided in the rear of the bearing levers 23 for biasing the levers 23 into their retention position. The holder 21 is pushed down by the compressive pressure of this spring, and the blade of the doctor blade 3-1 is pressed against the upper surface of the printing plate.

Figure 8A:
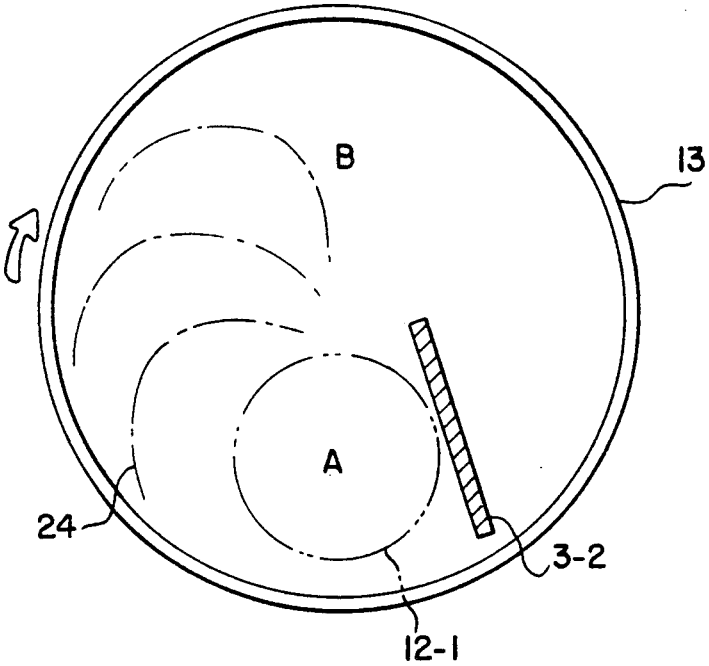
FIGS. 8(*a*) and 8(*b*) illustrate a linear doctor blade and ink guide.
Figure 8B:
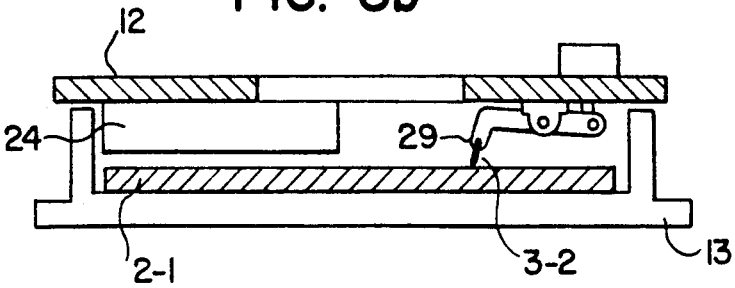

FIGS. 8(*a*) and (*b*) show linear doctor blade 3-2 pushed onto the printing plate 2-1. The ink guide 24 is retained at the ink tray cover 12 so as to maintain a predetermined clearance between itself and the surface of the printing plate. When the ink tray 13 rotates, the doctor blade 3-2 scrapes the ink off the design, and the ink guide 24 brings the thus scraped ink back to the printing plate for covering the whole surface thereof.

Figure 9:
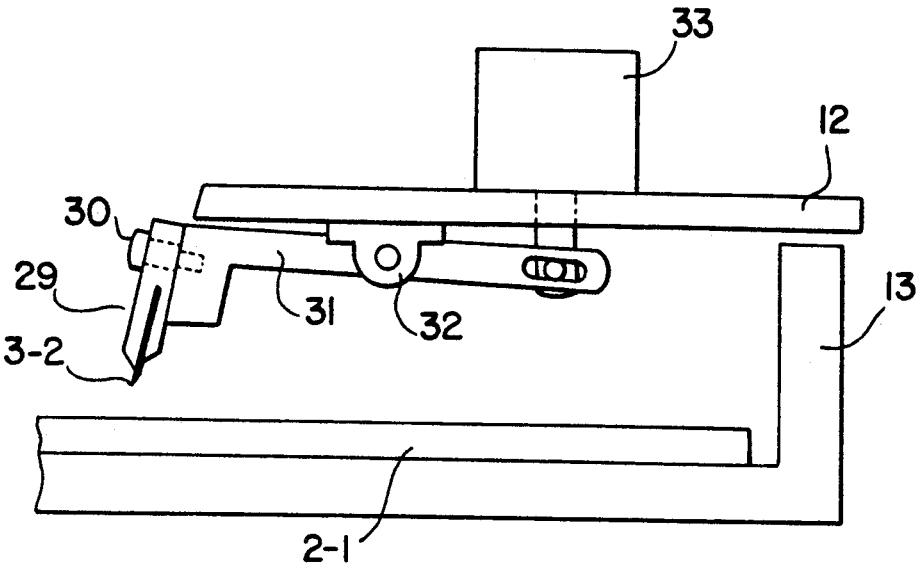
FIG. 9 illustrates a linear doctor blade and its movable parts.

In FIG. 9, the linear doctor blade 3-2 is fixed by inserting it into the doctor blade holder 29. While the doctor blade holder 29 is attached to the holder arm 31 by a holder mounting bolt 30, it is so arranged to be swingable around the bold 30. The arm 31 is retained to the ink tray cover 12 by the rotating shaft bracket 32 which functions as the fulcrum for moving the doctor blade 3-2 up and down. The moving of the doctor blade 3-2 up and down is effected by the air cylinder 33.

Figure 10:
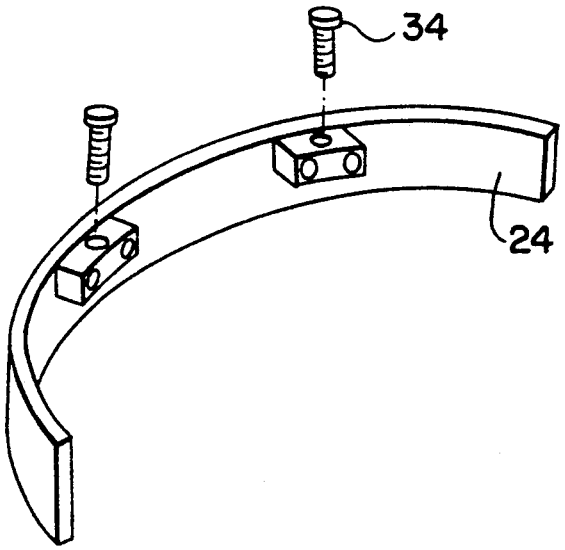
FIG. 10 illustrates an ink guide.

The ink guide 24, as shown in FIG. 10, is fixed to the ink tray cover 12 by the ink guide fixing bolts 34. While the ink guide shown in this drawing is in a curved shape, it could be of a linear shape as long as it is shaped so as to be able to bring back the ink which has been gathered in the central portion and the circumferential portion of the ink tray.

Figure 11A:
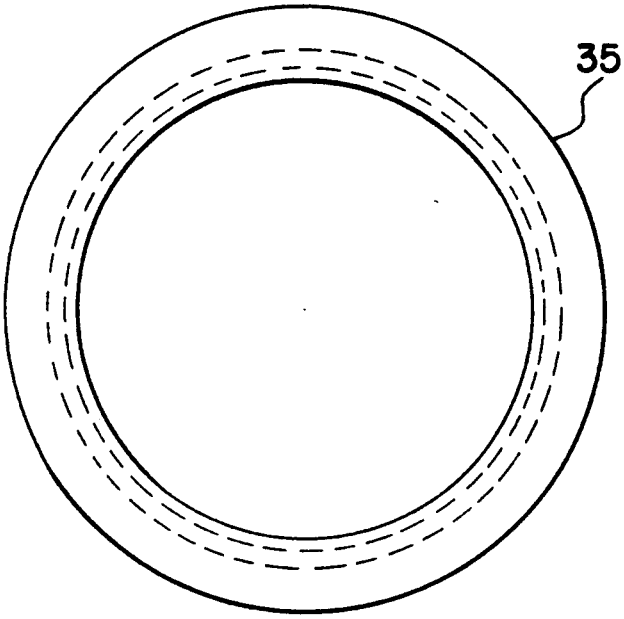
FIGS. 11(*a*) and 11(*b*) illustrate an evaporation preventing tube.
Figure 11B:
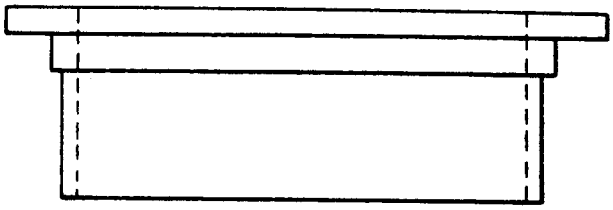

FIG. 11 shows a thinner evaporation preventing tube 35 insertable into the pad passing port 12-1 when the linear doctor blade 3-2 is employed. The lower end of the thinner evaporation preventing tube 35 keeps only little clearance between itself and the upper surface of the printing plate, for restraining the evaporation of the thinner from the ink.

Figure 12A:
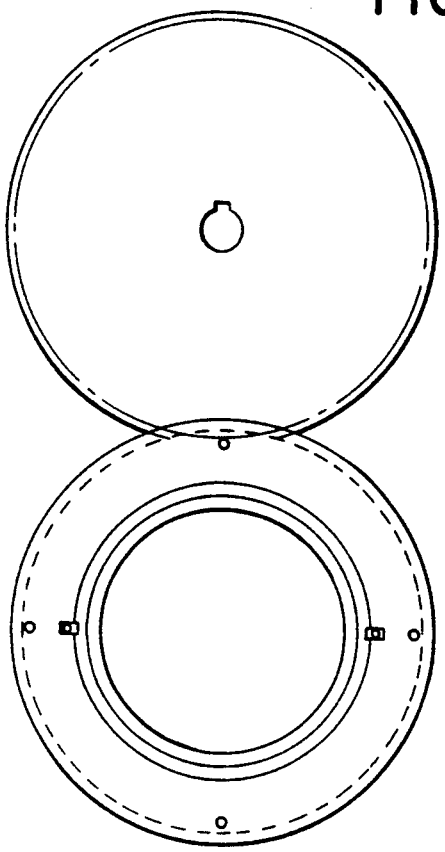
FIG. 12(*a*) and 12(*b*) illustrate an arrangement for rotating both a printing plate and a doctor blade.
Figure 12B:
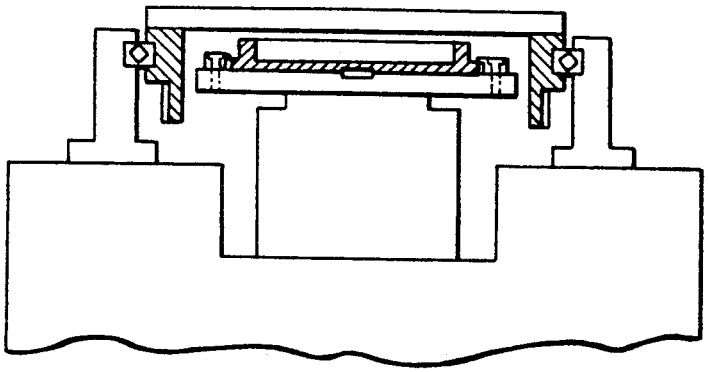

FIG. 12(*a*) shows a driving side gear 17-1 for rotating the ink tray cover 12-2 as in FIG. 4. However, the index drive 11-3 for driving is omitted from the drawing.

FIG. 12 (*b*) shows that the ink tray 13 can be rotated by the index drive 11 as in FIG. 3.

Figure 13A:
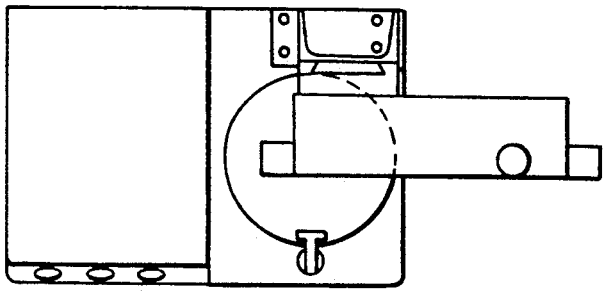
FIGS. 13(*a*), 13(*b*) and 13(*c*) illustrate a pad printing machine in which a pad executes linear back-and-forth movement.
Figure 13B:
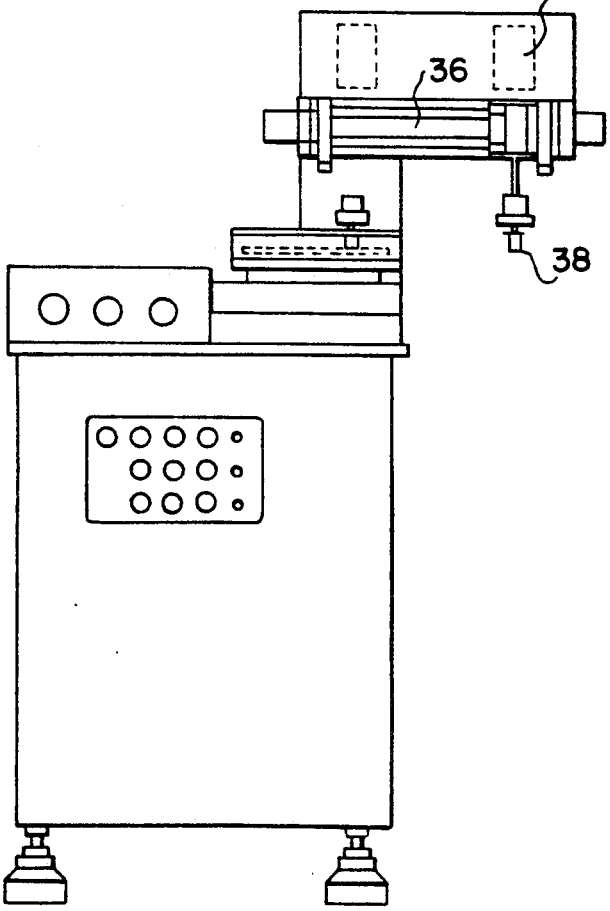
Figure 13C:
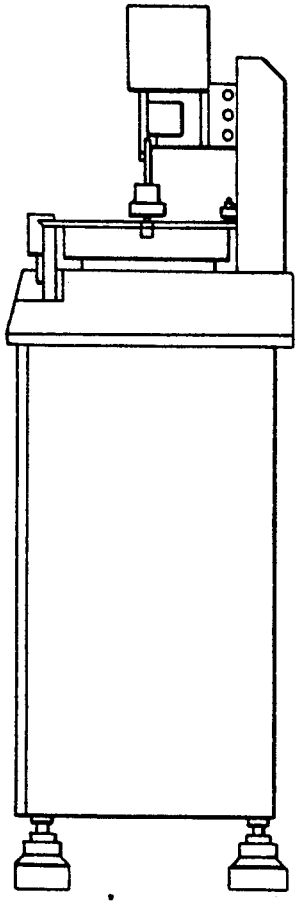

FIG. 13 shows that the pad 38 of a pad printing machine is moved in a horizontal plane in back-and-forth manner and in a vertical manner. The doctoring system according to the present invention is employed, and the air cylinder 36 moves the pad 38 horizontally, and the air cylinder 37 moves the pad vertically.

Figure 14A:
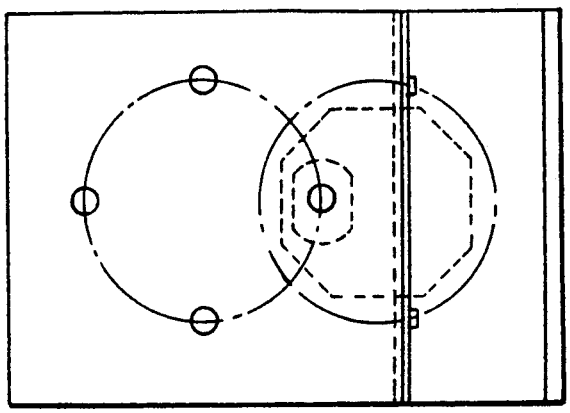
FIGS. 14(*a*) and 14(*b*) illustrate a pad printing machine in which a pad executes rotative movements.
Figure 14B:
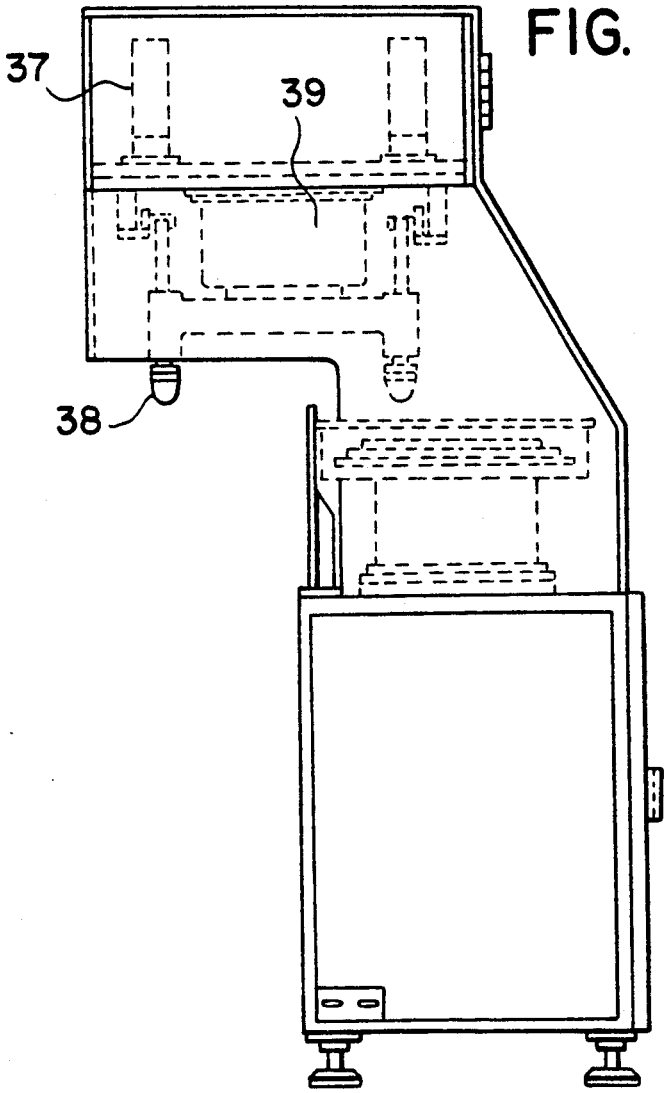

FIG. 14 shows a modification in which the pad 38 is fed horizontally in an intermittent manner and is moved vertically. The doctoring system according to the present invention is also employed, and the index drive 39 is to rotatively feed the pad 38 in an intermittent manner, and the air cylinder 37 moves the pad 38 vertically.

The ink feeding and doctoring operation of the arrangement described above will be made with reference to FIGS. 15(*a*), 15(*b*) and 15(*c*).

When the printing plate rotates, the ink covering the upper surface of the printing plate moves from the part F towards the parts G and H. As the is scraped by the ink linear doctor blade 3-2 placed at the position 8, there will be no ink in areas between ①-①′ (②-②′). The ink which was present between ①-①′ is either stagnating at the H side of the doctor blade or forced out towards an arrow mark ① and an inner wall of the ink tray or towards interior beyond ①′ and is carried from the part A to the part B along with the rotation of the printing plate. This ink forced out from both ends of the doctor blade is hauled into a central portion of the ink guide (24) in front of the ink guide at the position (2) as shown by arrow marks ③, ③′. The clearance between the lower end of the ink guide and the surface of the printing plate is set to such gap as the swollen up portion of forced out ink is scraped, for example, 0.5 mm to 1.0 mm. Further, since the ink guide is so set as forming angles a and b with the normal line, the ink which has been scraped and has its movement towards the rotating direction hindered moves towards the central portion of the ink guide that is to the direction of the arrows ③, ③′. The ink which has eventually crept under he ink guide (which is at the C side) covers again the part ②, ②′ where there is no ink, and flows towards the direction of ④. What is described above is the basic process of returning the ink.

The ink having its movement towards the rotating direction hindered by the ink guide stagnates at the side B of the ink guide until it creeps under the same as shown by the arrow ④ while moving towards the direction of ③ or ③′, and is subject to rolling. Similar thing will take place at the side H of the doctor blade, thus the ink will be well kneaded by this rolling action.

While one (or one set of) ink guide will suffice, it is better to provide two or more of them for surely spreading the ink towards the central portion of the ink guide and for better kneading of the ink. The ink guide at the position (4) is an example of such arrangement. The ink guide at the position (4) should have its length made longer and its clearance with the printing plate made narrower for more effective ink spread and ink kneading.

The angle c between the doctor blade and the normal line may be 0 degree, or of plus value or minus value. When the doctor blade is set with its angle made at a plus value as shown in the drawing, an amount of forced out ink will be greater at the side wall side of the ink gray (① which is at the inner wall of the ink tray). As the angle c is changed to a minus value, the ink will start to stagnate more at the interior side of the printing plate, and eventually there will be no ink at the side of the ink tray wall.

The design to be printed is formed on the surface of the printing plate and is recessed below the surface. This recessed part will be doctored and appear between ①- ①′ (②- ②′). While the ink at the surface of the printing plate is scraped off by doctoring, the ink at the recessed part will remain in place and a pad descending at the position (1) will pick up the same. The recessed part will creep under the ink again between the parts C, D and the parts G, H.

Figure 15A:
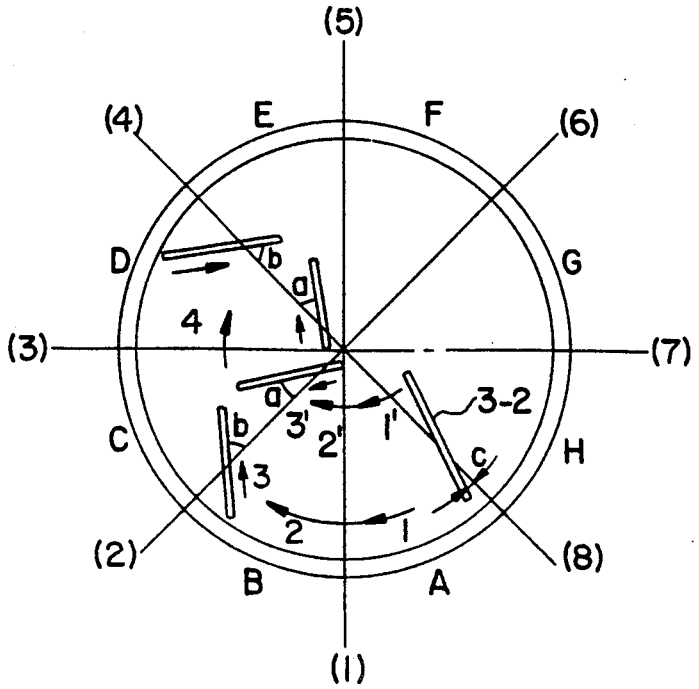
FIGS. 15(*a*), 15(*b*) and 15(*c*) illustrate schematically the doctoring operation of the arrangement described above.
Figure 15B:
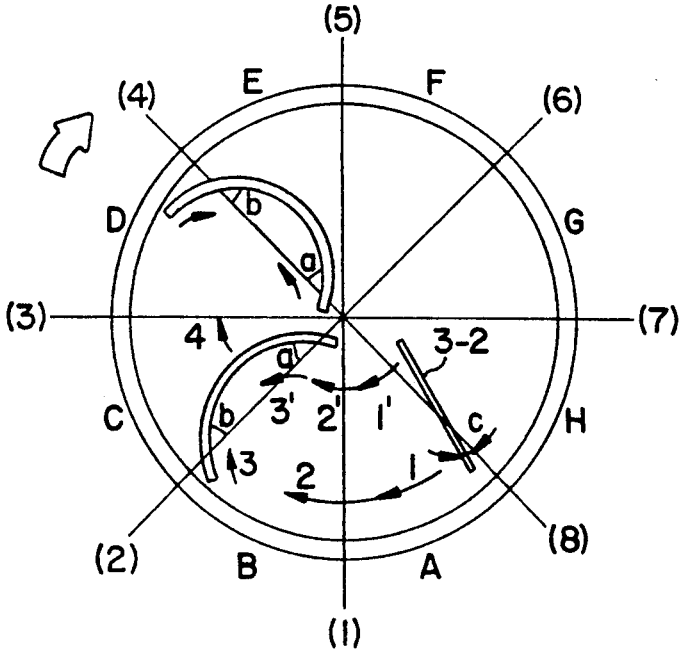
Figure 15C:
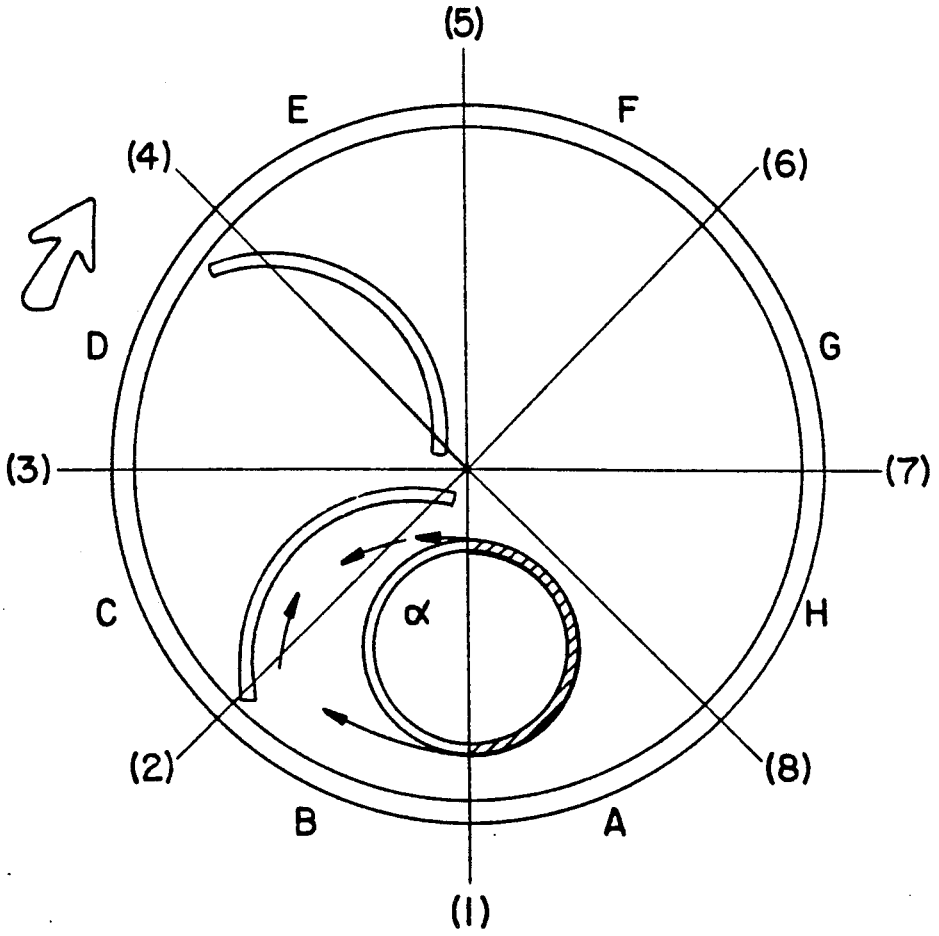

FIG. 15(*c*) shows a case when a doctor blade which is wound in a cylindrical manner is used. Only a hatched portion at the side A of this cylindrical shape functions as a doctor blade. The portion which is left blank at the side B does not have to contact the surface of the printing plate. It may be a shape with ends of cylindrical shape doctor blade forming a gap $\propto$ as shown in the drawing. The ink flows in the same manner as shown in FIG. 15(*a*) and 15(*b*).

While specific embodiments of the invention have been shown and described in detail to illustrate the application of the inventive principles, it will be understood that the invention may be embodied otherwise without departing from such principles.

We claim:

1. An inking and doctoring arrangement for a pad printing press, comprising:

a replaceable flat printing plate;

a doctor blade arranged above said printing plate and displaceable relative thereto for scraping ink from the upper surface thereof;

an ink tray for fixedly receiving said printing plate;

a tray cover rotatably supported with respect to said ink tray above said printing plate, and an ink guide fixedly secured to said tray cover for joint rotation therewith for spreading ink scraped by said doctor blade over an upper surface of said printing plate while kneading the same.

2. An arrangement according to claim 1, wherein said tray cover has a surface large enough to cover the entire upper surface of said ink tray for minimizing evaporation of a thinner from the ink and for preventing foreign matters from entering into the ink, and an insertion port formed in said surface for inserting said doctor blade therethrough, said insertion port having a size that enables a pad for picking ink from a recessed portion of said printing plate to pass through said insertion port, said arrangement further comprising an evaporation preventing tube received in said insertion port.

3. An arrangement according to claim 1, wherein said tray cover has a surface large enough to cover the entire upper surface of said ink tray for minimizing evaporation of a thinner from the ink and for preventing foreign matter from entering into the ink and an insertion port formed in said surface for inserting said doctor blade therethrough, said doctor blade comprising a blade wound about a cylindrical blade holder insertable into said inserting port and having an inner diameter large enough to enable a pad for picking ink from a recessed portion of said printing plate to pass therethrough, said arrangement further comprising means for supporting said doctor blade holder for swinging about an x-y axis, said blade having a lower end biased into engagement with said upper surface of said printing plate.

4. An arrangement according to claim 1, wherein said tray cover has a surface large enough to cover the entire upper surface of said ink tray for minimizing evaporation of a thinner from the ink and for preventing foreign matter from entering into the ink, and an insertion port formed in said tray cover surface for inserting said doctor blade therethrough, said doctor blade comprising a cylindrical blade member insertable into said insertion port and having an inner diameter large enough to enable a pad for picking ink from a recessed portion of said printing plate to pass therethrough, said arrangement further comprising means for supporting said doctor blade member for swinging about an x-y axis, said blade member having a lower end biased into engagement with said upper surface of said printing plate for effecting a doctoring function.

5. An arrangement according to claim 2, wherein a seal is provided between said ink tray and said tray cover for further preventing evaporation of an ink thinner.

6. An arrangement according to claim 1, further comprising drive means arranged in a lower portion of said ink tray for intermittently rotating the same, said tray cover being supported with regard to said ink tray in such a manner that a constant clearance is maintained between said upper surface of said printing plate.

7. An arrangement according to claim 1, further comprising means for supporting said ink tray, a body for supporting said ink cover, means for supporting said body on said ink tray, supporting means for rotation about the center of said printing plate, and drive means for intermittently unidirectionally rotating said body, with a clearance between said upper surface of said printing plate and said tray cover being maintained constant.

8. An arrangement according to claim 1, further comprising means for intermittently unidirectionally rotating said ink tray about the center of said printing plate.

* * * * *